US008853925B2

(12) United States Patent
Broudno

(10) Patent No.: US 8,853,925 B2
(45) Date of Patent: Oct. 7, 2014

(54) HIGH EFFICIENCY SPARK PLUG

(76) Inventor: Grigori Broudno, Toronto (CA)

( * ) Notice: Subject to any disclaimer, the term of this patent is extended or adjusted under 35 U.S.C. 154(b) by 0 days.

(21) Appl. No.: 13/261,281

(22) PCT Filed: Dec. 1, 2011

(86) PCT No.: PCT/CA2011/001339

§ 371 (c)(1),
(2), (4) Date: May 2, 2012

(87) PCT Pub. No.: WO2013/078528

PCT Pub. Date: Jun. 6, 2013

(65) Prior Publication Data

US 2014/0252941 A1 Sep. 11, 2014

(51) Int. Cl.
*H01T 13/20* (2006.01)

(52) U.S. Cl.
CPC ..... *H01T 13/20* (2013.01)
USPC ..... 313/141

(58) Field of Classification Search
CPC ..... H01T 13/02; H01T 13/00; H01T 13/32; H01T 13/52; H01T 13/54; H01T 13/20
See application file for complete search history.

*Primary Examiner* — Donald Raleigh
(74) *Attorney, Agent, or Firm* — David W Wong

(57) ABSTRACT

A high efficiency spark plug operative to produce negligible waste materials discharge from the combustion engine with high power output and low fuel consumption. The spark plug has an upper chamber formed by an annular partition ring mounted at an upper position of the cylindrical cavity located in the lower portion of the shell of the spark plug. A cylindrical sleeve mounted in the cavity and located below the annular partition ring. A horizontal annular shoulder in the cylindrical sleeve extending in a horizontal position and separating the interior of the cylindrical sleeve into a middle chamber and a lower chamber. The annular shoulder formed the grounding electrode with an edge of its inner opening located in a spaced manner from the spark tip of the central electrode.

10 Claims, 2 Drawing Sheets

HIGH EFFICIENCY SPARK PLUG

This application is a National Stage entry of International Application No. PCT/CA2011/01339 filed Dec. 1, 2011 and is incorporated herein by reference

TECHNICAL FIELD

The present invention relates to a spark plug for the internal combustion engine, and more particularly relates to a high efficiency spark plug.

BACKGROUND ART

Internal combustion engines employ spark plugs for igniting the air and fuel mixture in the engine cylinder combustion chamber for providing the power to rotate the crank shaft. Heretofore, spark plugs are provided with electrodes located outside the bottom end of the spark plug body to extend into the engine combustion chamber. In operation, the electrodes are exposed to the extremely high heat produced in the combustion chamber, which causes physical erosion of the electrodes. Also, burned particles such as carbon are deposited on the electrodes to result in the loss of effectiveness of the ignition function of the spark plug. Approximately, 80% of the air and fuel mixture is burned in each cycle of the ignition of a conventional spark plug. A large amount of waste materials including noxious gases such as carbon monoxide, carbon dioxide, nitrogen oxides and hydrocarbon and other partially burned or unburned materials are produced in the engine chamber in the ignition. Some of the materials and noxious gases are discharged from the engine to the atmosphere, which cause pollution of the latter. The pollution may be reduced by passing the discharge through a catalytic converter. However, the remaining waste materials in the ignition chamber will mix with the fresh air and fuel mixture subsequently injected into the ignition chamber to form a contaminated and degraded fuel mixture which inherent causes the reduction of the ignition efficiency and the loss of power output from the engine with high consumption of fuel. Furthermore, with the electrodes of the spark plug located in the combustion chamber, ignition would occurs in the combustion chamber of the engine so that the component parts in the combustion chamber are subjected directly to the high temperature of the combustion. The high temperature reduces the life of the engine due to heat stress of the components.

Attempts have been made to provide new spark plug constructions with the electrodes located within a hollow pre-ignition chamber formed in the spark plug body or shell surrounding the electrodes in a spaced manner. The central electrode and the grounding electrode are recessed and spaced from the lower opening of the pre-ignition chamber. The grounding electrode may also separate the pre-ignition chamber into a lower chamber between the central electrode and the lower opening of the shell and an upper chamber surrounding the insulated portion of the central electrode. Ignition occurs in the lower chamber so that the flame is injected into the cylinder chamber to ignite the air and fuel mixture therein resulting in less waste materials produced in the ignition and less high temperature exposure to the engine components. However, waste materials still produced in the pre-ignition chamber. The waste materials, again as in the conventional spark plug, would mix with the fresh air and fuel mixture injected into the cylinder chamber to form a concentrated polluted mixture in the pre-ignition chamber to cause unsatisfactory ignition and back fire.

SUMMARY OF THE PRESENT INVENTION

It is a principal object of the present invention to provide an improved spark plug which operates with negligible amount of pollutant produced in the ignition and in the combustion engine exhaust discharge.

It is another object of the present invention to provide an improved spark plug which is operative with high ignition efficiency and low fuel consumption.

It is another object of the present invention to provide an improved spark plug construction having three chambers including a lower chamber located below the grounding electrode and the central electrode, a middle chamber surrounding the insulated lower portion of the central electrode and an upper chamber surrounding the upper insulated portion of the insulator to maintain it in an optimum operating temperature.

It is yet another object of the present invention to provide an improved spark plug construction to provide maximum power output of the ignition of the air and fuel mixture injected into the cylinder chamber of the internal combustion engine.

BRIEF DESCRIPTION OF THE DRAWINGS

Other objects and advantages of the present invention will become apparent from the following description of the preferred embodiments thereof in connection with accompanying drawings in which.

DETAILED DESCRIPTION OF THE PREFERRED EMBODIMENTS

Figure 1:
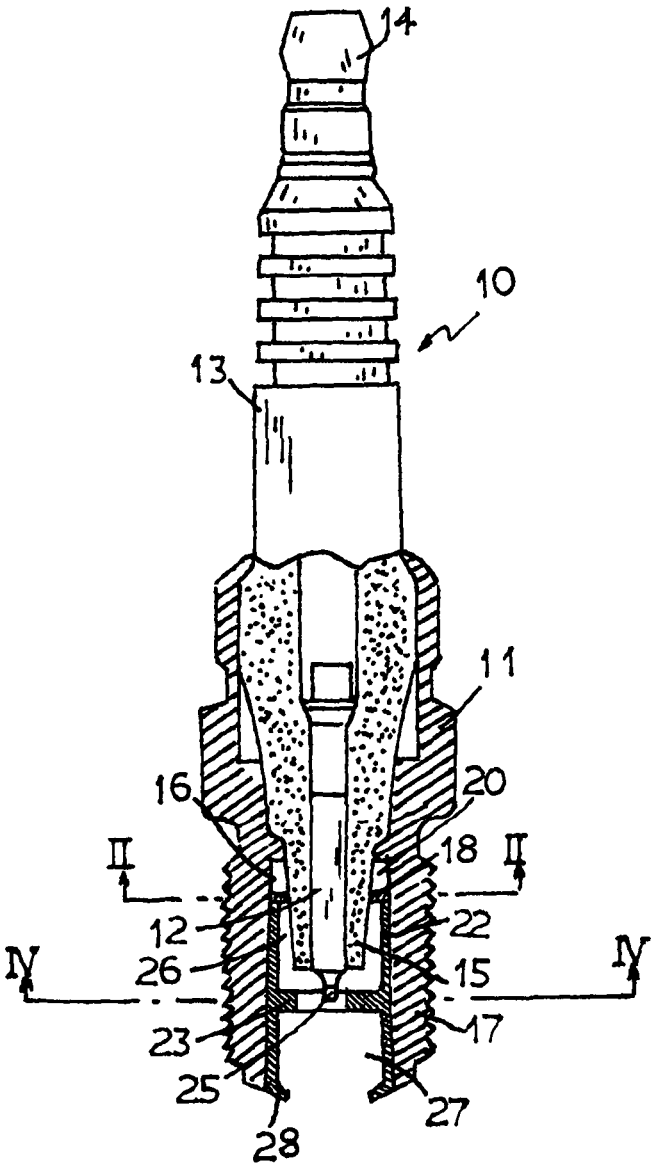
FIG. 1 is a partial cross sectional perspective side elevation view of the spark plug of the present invention.

With reference to the drawings wherein like reference numerals in the various views designate corresponding parts, the spark plug 10 of the present invention has a generally cylindrical metal body or shell 11 similar to a conventional spark plug. Threads are provides on the outer surface of the lower portion of the shell 11 for mounting the spark plug 10 to an internal combustion engine. The central electrode 12 is made of a high temperature resistant noble metal or metal alloy and it is surrounded and imbedded in a ceramic insulator 13 which has an upper portion 13 extending upwards from the top of the shell 11, and an electrical connection terminal 14 is located at the top of the central electrode for conducting the ignition current to the spark plug. The lower portion of the ceramic insulator 13 has a generally frusto-conical lower end portion 15 extending downwardly into a hollow cylindrical cavity 16 located within the lower end portion 17 of the shell 11. Threads are provided on the outer surface of the lower end portion of the shell 11 for mounting the spark plug to the cylinder head of an internal combustion engine.

Figure 2:
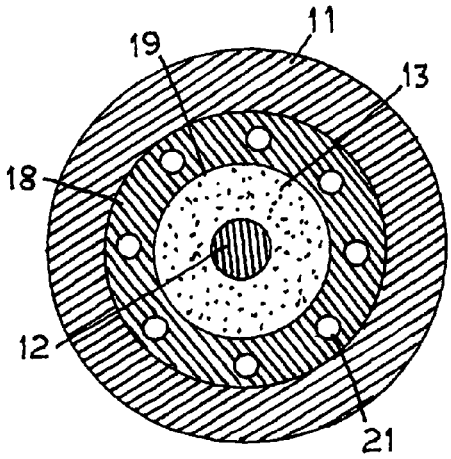
FIG. 2 is an enlarged bottom cross sectional elevation view along the cross section line II-II of FIG. 1.
Figure 3:
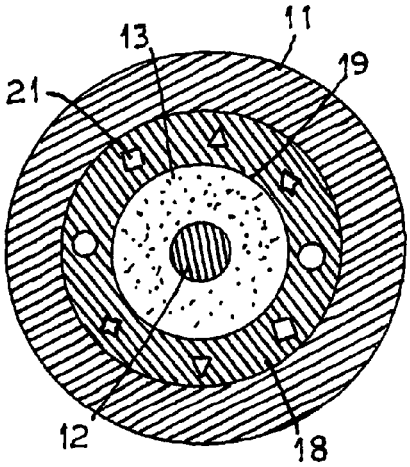
FIG. 3 is an enlarged bottom cross sectional elevation view along the cross section line II-II of FIG. 1 showing communication openings of various shapes formed in the annular ring.

An annular partition ring 18 is located in a generally horizontal position within the cylindrical cavity 16 and is spaced from the upper end of the latter. The annular partition ring 18 is made of a high temperature resistant noble metal or metal alloy and it has an outer diameter equal to the inner diameter of the cylindrical cavity 16 and a central inner opening 19 having a diameter equal to the outer diameter of a predetermined position of the frusto-conical lower end portion 15 of the ceramic insulator 13 such that when the annular partition ring 18 is inserted into the cylindrical cavity 16 it is retained in the predetermined position horizontally such that an upper chamber 20 is formed at the upper portion of the cylindrical cavity 16 with the inner opening 19 of the annular partition ring 18 intimately engaged with the conical side wall of the lower end portion of the ceramic insulator 13. A plurality of through openings 21 are formed in the annular partition ring 18 as shown in FIGS. 2 and 3. The through openings 12 may have various shapes including circular, rectangular, or multi-angular shapes as best shown in FIG. 3. The through openings 12 may be all of the same shape or a mixture of the various different shapes.

Figure 4:
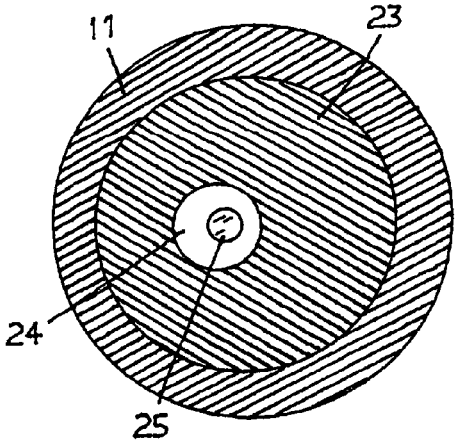
FIG. 4 is an enlarged bottom cross sectional elevation view along the cross section line IV-IV of FIG. 1.
Figure 5:
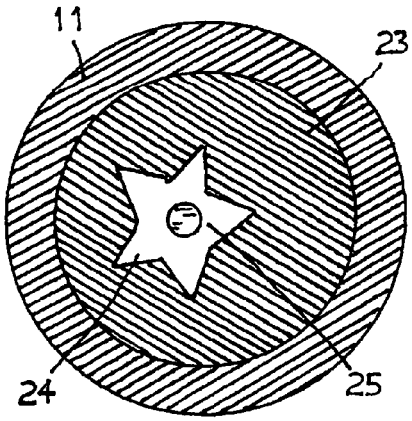
FIG. 5 is an enlarged bottom cross sectional elevation view along the cross section line IV-IV of FIG. 1 showing an alternative multi-angular opening formed in the grounding electrode.

A cylindrical sleeve 22 also made of a high temperature noble metal or metal alloy is located within the lower portion of the cylindrical cavity 12 below and abutting the annular partition ring 18. The cylindrical sleeve 22 has an outer diameter equal to the inner diameter of the cylindrical cavity 12 such that it is snugly mounted within the latter. The cylindrical sleeve 22 has an annular shoulder member 23 having an inner opening 24 with a flange extending inwardly and horizontally at a predetermined location from the inner side wall of the cylindrical sleeve 22. The annular shoulder member 23 forms the grounding electrode of the spark plug with the edge of the inner opening 24 located directly spaced from the spark tip 25 of the central electrode 12. The shoulder member 23 separates the inner cavity of the cylindrical sleeve 22 into a middle chamber 26 and a lower outer chamber 27 as shown in FIG. 1. The middle chamber 26 is located above the grounding electrode and the lower chamber is located below the grounding electrode. The middle chamber 26 communicate with the upper chamber 20 through the through openings 12 in the annular partition ring 18. The spacing between the edge of the inner opening 24 of the grounding electrode and the spark tip 25 of the central electrode 12 provides the spark gap of the spark plug. The center of the inner opening 24 is preferably offset from the vertical longitudinal axis of the central electrode 12 such that the tip 25 is positioned closer to one side edge of the inner opening 24 as best shown in FIGS. 1, 4 and 5 in order to achieve a more intense spark in operation. The inner opening 24 of the grounding electrode may have various shapes including circular or multi-angular shape as shown in FIGS. 4 and 5.

The locations of the annular partition ring 18 in the cavity 16 and the grounding electrode 23 in the cylindrical sleeve 22 are determined by the compression ratio of the air and fuel mixture in the combustion chamber of the internal combustion engine in which the spark plug is to be installed, as shown in the following formula:

$$V_3 = \frac{V_1 + V_2}{\epsilon} \text{mm}^3$$

in which $V_1$ is the volume of the lower chamber 27

$V_2$ is the volume of the middle chamber 26

$V_3$ is the volume of the upper chamber 20, and $\epsilon$ is the compression ratio of the air/fuel mixture in the combustion chamber The rim 28 of the bottom opening of the lower chamber 27 is preferably slanting inwardly and downwardly as shown in FIG. 2 to provide a reduced bottom opening which guides and accelerates the ignition flame from the lower chamber 27 into the combustion chamber of the engine.

In operation, initially the air and fuel mixture is injected into the combustion chamber of the combustion engine as well as the lower chamber of the spark plug. The mixture in the lower chamber 27 is ignited by the spark between the central electrode and the ground electrode occurring at the spark gap of the spark plug. Any high temperature unburned materials and/or noxious gases produced in the ignition is mainly confined within the lower chamber of the spark plug. The ignition will cause the air and fuel mixture in the combustion chamber to ignite instantaneously. Subsequent fresh air and fuel mixture injected into the combustion chamber of the engine will force the high temperature waste materials and/or noxious gas, if any, in the lower chamber 27 to rise mainly into the middle chamber and then through the openings 21 of the partition annular ring 18 into the upper chamber of the spark plug. Thus, the components in the combustion chamber of the engine are not subjected to the high temperature of the combustion; and the temperature in the combustion chamber only rises for the short period in the ignition and they are, in fact, cooled by the incoming fresh air and fuel mixture. Thus, it reduces the temperature stress to the engine components. The high temperature waste materials and/or any obnoxious gases are confined within the upper chamber and middle chamber so that they maintain the spark plug at an optimum operating temperature. In this manner, the high temperature is utilized to maintain the optimum temperature of the spark plug to result in a high efficiency in ignition and power output with less fuel consumption and longer engine life.

Since the partition annular ring 18, the cylindrical sleeve 22 and the central electrode 25 and the grounding electrode 23 are all made of high temperature noble metal or metal alloy, they are not subject to high temperature erosion. Also, cleaning and re-setting of the spark gap are not required.

Only a small amount of the waste materials in the middle chamber and the upper chamber of the spark plug is drawn back into the lower chamber in the subsequent repeated combustion operations and it is being burned and eliminated in the further combustion such that discharge of unburned waste materials from the engine is minimal. Therefore, discharge of pollution to the atmosphere of unburned waste materials from the engine using the present spark plug is negligible.

I claim:

1. A high efficiency spark plug comprising, a central electrode imbedded in a high temperature insulator, said insulator having a frusto-conical lower portion extending into a cylindrical cavity located at a lower portion of a metal shell, an annular partition ring mounted in said cylindrical cavity for forming an upper chamber in an upper portion of said cylindrical cavity, a cylindrical sleeve mounted in said cylindrical cavity and located below said annular partition ring, said cylindrical sleeve having an outer diameter equal to the diameter of said cylindrical cavity and a length extending from said annular partition ring to a bottom opening of said cylindrical cavity, said cylindrical sleeve encircling said frusto-conical lower portion of said insulator in a spaced manner, an annular shoulder formed in said cylindrical sleeve, said annular shoulder dividing said cylindrical sleeve into a middle chamber and a lower chamber and having an inner opening with an inner edge located at a predetermined space from a spark tip of said central electrode.

2. A high efficiency spark plug according to claim 1 including a plurality of through openings formed in said annular partition ring, and said upper chamber being communicative with said middle chamber through said through openings of said annular partition ring.

3. A high efficiency spark plug according to claim 2 wherein said annular partition ring and said cylindrical sleeve are made of a high temperature resistant material chosen from the group consisting of a noble metal and noble metal alloy.

4. A high efficiency spark plug according to claim 3 wherein said spark tip is located in a spaced manner closer to one side of said inner edge of said inner opening of said annular shoulder.

5. A high efficiency spark plug according to claim 3 wherein said through openings in said annular partition ring have a selective shape chosen from the group consisting of circular shape, rectangular shape and multi-angular shape.

6. A high efficiency spark plug according to claim 5 wherein said inner opening of said annular shoulder in said cylindrical sleeve has a circular shape.

7. A high efficiency spark plug according to claim 5 wherein said inner opening of said annular shoulder in said cylindrical sleeve has a multi-angular shape.

8. A high efficiency spark plug comprising, a central electrode imbedded in a vertical position in a high temperature ceramic insulator, said insulator having a frusto-conical lower portion extending into a cylindrical cavity located at a lower portion of a metal shell, an annular partition ring made of a high temperature resistant material and mounted in a generally horizontal manner in said cylindrical cavity for forming an upper chamber in an upper portion of said cylindrical cavity, a cylindrical sleeve made of a high temperature resistant material and mounted in said cylindrical cavity and located below said annular partition ring, said cylindrical cavity having a diameter equal to an outer diameter of said cylindrical sleeve and said cylindrical sleeve having a length extending from said annular partition ring to a bottom opening of said cylindrical cavity, said cylindrical sleeve encircling said fruto-conical lower portion of said insulator in a spaced manner, an annular shoulder formed in said cylindrical sleeve, said annular shoulder dividing said cylindrical sleeve into a middle chamber and a lower chamber and having an inner opening with an edge located at a predetermined space from a spark tip of said central electrode, the location of said annular partition ring in said cylindrical cavity, and the location of said annular shoulder in said cylindrical sleeve being determined according to the following formula:

$$V_3 = \frac{V_1 + V_2}{\epsilon} \text{mm}^3$$

wherein $V_1$ is the volume of said lower chamber $V_2$ is the volume of said middle chamber $V_3$ is the volume of said upper chamber, and $\epsilon$ is the volume of a predetermined compression ratio of the air and fuel mixture in said combustion chamber of said engine.

9. A high efficiency spark plug according to claim 8 wherein said central electrode having a spark tip located in a spaced manner closer to one side edge of said inner opening of said annular shoulder.

10. A high efficiency spark plug according to claim 8 wherein said cylindrical sleeve having a convergent lower opening formed by a flange extending downwardly and sloping inwardly toward the vertical central axis of said cylindrical sleeve.

* * * * *